US010780602B2

(12) United States Patent
Gereg et al.

(10) Patent No.: US 10,780,602 B2
(45) Date of Patent: Sep. 22, 2020

(54) CLAMPING ASSEMBLIES AND SLICING MACHINES EQUIPPED THEREWITH

(71) Applicant: URSCHEL LABORATORIES, INC., Chesterton, IN (US)

(72) Inventors: Dustin Joseph Gereg, Lowell, IN (US); Michael Scot Jacko, Valparaiso, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 0 days.

(21) Appl. No.: 16/394,048

(22) Filed: Apr. 25, 2019

(65) Prior Publication Data

US 2019/0329437 A1 Oct. 31, 2019

Related U.S. Application Data

(60) Provisional application No. 62/662,289, filed on Apr. 25, 2018, provisional application No. 62/682,386, filed on Jun. 8, 2018.

(51) Int. Cl.

| | |
|---|---|
| ***B26D 1/03*** | (2006.01) |
| ***B26D 7/26*** | (2006.01) |
| ***B26D 7/06*** | (2006.01) |

(52) U.S. Cl.

CPC ..... *B26D 7/2614* (2013.01); *B26D 1/03* (2013.01); *B26D 7/0691* (2013.01); *B26D 2210/02* (2013.01)

(58) Field of Classification Search

CPC ..... B26D 7/2614; B26D 1/03; B26D 7/0691; B26D 7/26; B26D 7/06

USPC ..... 83/403, 698.11–699.61

See application file for complete search history.

(56) References Cited

U.S. PATENT DOCUMENTS

| | | | | |
|---|---|---|---|---|
| 3,139,127 | A * | 6/1964 | Urschel | B26D 7/0691 83/161 |
| 3,139,128 | A * | 6/1964 | Urschel | B26D 1/0006 83/111 |
| 3,139,129 | A * | 6/1964 | Urschel | B26D 1/0006 83/13 |
| 3,139,130 | A * | 6/1964 | Urschel | B26D 1/03 83/13 |
| 3,599,523 | A * | 8/1971 | Pickett | G01N 1/06 83/412 |

(Continued)

*Primary Examiner* — Kenneth E Peterson

*Assistant Examiner* — Nhat Chieu Q Do

(74) *Attorney, Agent, or Firm* — Hartman Global IP Law; Gary M. Hartman; Domenica N.S. Hartman

(57) ABSTRACT

Slicing machines having a cutting head equipped with one or more cutting units mounted thereto for securing knives to the cutting head. The cutting head has structural members spaced apart in an axial direction of the cutting head and circumferentially-spaced cutting units between the structural members. Each cutting unit includes a knife holder adapted for supporting a knife, a clamp overlying the knife holder and arranged to apply a clamping force to a knife disposed between the knife holder and clamp, and a cam rod adapted to apply a clamping force to the clamp. The clamp has upstanding flanges, each having a hole therethrough and a slot that engages a pivot, and the clamp, slots, cam rod, and pivots are arranged so that the clamp both pivots and translates relative to the pivots as the cam rod rotates between clamping and release positions.

19 Claims, 9 Drawing Sheets

(56) References Cited

U.S. PATENT DOCUMENTS

| | | | | | |
|---|---|---|---|---|---|
| 4,523,503 | A * | 6/1985 | Julian | B26D 1/03 | 83/403 |
| 4,700,600 | A * | 10/1987 | Pickett | G01N 1/06 | 83/165 |
| 5,694,824 | A * | 12/1997 | Jacko | B26D 1/03 | 83/403 |
| 6,112,420 | A * | 9/2000 | Schickerling | B23D 51/10 | 279/77 |
| 6,209,436 | B1 * | 4/2001 | Smithwick | B26F 1/44 | 83/698.11 |
| 6,968,765 | B2 * | 11/2005 | King | B26D 7/0691 | 83/403 |
| 7,658,133 | B2 * | 2/2010 | Jacko | B26D 1/03 | 83/403 |
| 8,161,856 | B2 * | 4/2012 | Jacko | B26D 1/36 | 83/403 |
| 8,714,068 | B2 * | 5/2014 | Ornelaz, Jr. | B26D 7/2614 | 83/403 |
| 9,193,086 | B2 * | 11/2015 | Jacko | B26D 7/2614 | |
| 9,469,041 | B2 * | 10/2016 | King | B26D 1/03 | |
| 9,517,572 | B2 * | 12/2016 | Michel | B26D 1/0006 | |
| 2016/0158953 | A1 * | 6/2016 | King | B26D 7/08 | 83/13 |
| 2016/0361831 | A1 * | 12/2016 | Fant | B26D 7/2614 | |
| 2018/0229390 | A1 * | 8/2018 | Gereg | B26D 7/0691 | |
| 2018/0333866 | A1 | 11/2018 | Wagner et al. | | |
| 2018/0333886 | A1 * | 11/2018 | Gereg | B26D 1/0006 | |

* cited by examiner

CLAMPING ASSEMBLIES AND SLICING MACHINES EQUIPPED THEREWITH

CROSS-REFERENCE TO RELATED APPLICATIONS

This application claims the benefit of U.S. Provisional Application No. 62/662,289 filed Apr. 25, 2018, and U.S. Provisional Application No. 62/682,386 filed Jun. 8, 2018. The contents of these prior applications are incorporated herein by reference.

BACKGROUND OF THE INVENTION

The present invention generally relates to machines for cutting products, including but not limited to slicing food products. The invention particularly relates to clamping assemblies for securing knives to slicing machines, and to slicing machines equipped therewith.

Various types of equipment are known for slicing, shredding and granulating food products, as nonlimiting examples, vegetables, fruits, dairy products, and meat products. Widely used machines for this purpose are commercially available from Urschel Laboratories, Inc., and include machines under the names Model CC® and Model CCL. The Model CC and CCL machines are centrifugal-type slicers capable of slicing a wide variety of products at high production capacities. The Model CC® line of machines is particularly adapted to produce uniform slices, strip cuts, shreds and granulations, and the Model CCL line is particularly adapted to produce slices or chips of a waffle or lattice type. Certain configurations and aspects of Model CC® machines are represented in U.S. Pat. Nos. 3,139,128, 3,139,129, 5,694,824 and 6,968,765, the entire contents of which are incorporated herein by reference. Certain configurations and aspects of Model CCL machines are represented in U.S. Pat. Nos. 3,139,127 and 3,139,130, the entire contents of which are incorporated herein by reference.

FIG. 1 schematically depicts a machine 10 representative of a Model CC® machine. The machine 10 includes a generally annular-shaped cutting head 12 equipped with cutting knives (not shown) mounted at its inner circumference. An impeller 14 is coaxially mounted within the cutting head 12 and has an axis 17 of rotation that coincides with an axis of the cutting head 12. The impeller 14 is rotationally driven about its axis 17 through a shaft that is enclosed within a housing 18 and coupled to a gear box 16. The cutting head 12 is mounted on a support ring 15 above the gear box 16 and remains stationary as the impeller 14 rotates. Products are delivered to the cutting head 12 and impeller 14 through a feed hopper 11 located above the impeller 14. In operation, as the hopper 11 delivers products to the impeller 14, centrifugal forces cause the products to move outward into engagement with the knives of the cutting head 12. The impeller 14 comprises generally radially-oriented paddles 13, each having a face that engages and directs the products radially outward toward and against the knives of the cutting head 12 as the impeller 14 rotates. Other aspects pertaining to the construction and operation of Model CC® machines, including improved embodiments thereof, can be appreciated from U.S. Pat. Nos. 3,139,128, 3,139,129, 5,694,824, 6,968,765, 7,658,133, 8,161,856, 9,193,086, 9,469,041, and 9,517,572 and U.S. Patent Application Publication Nos. 2016/0158953 and 2016/0361831.

FIG. 2 is an isolated view of the cutting head 12 of FIG. 1, and FIG. 3 is a fragmentary bottom view of the cutting head 12. The cutting head 12 is generally annular-shaped with cutting knives 20 mounted on its perimeter. Each knife 20 projects radially inward in a direction generally opposite the direction of rotation of the impeller 14, and defines a cutting edge at its radially innermost extremity. The cutting head 12 shown in FIG. 2 further comprises a lower support ring 22, an upper support ring 24, and circumferentially-spaced support segments, referred to herein as shoes 26. The knives 20 of the cutting head 12 are individually secured with clamping assemblies 28 to the shoes 26. Each clamping assembly 28 includes a knife holder 28A mounted with fasteners 29 to the radially inward-facing side of a shoe 26, and a clamp 28B mounted on the radially outward-facing side of a shoe 26 to secure a knife 20 to the knife holder 28A. The shoes 26 are represented as secured with fasteners 30 to the support rings 22 and 24. The shoes 26 are equipped with coaxial pivot pins (not shown) that engage holes in the support rings 22 and 24. By pivoting on its pins, the orientation of a shoe 26 can be adjusted to alter the radial location of the cutting edge of its knife 20 with respect to the axis of the cutting head 12, thereby controlling the thickness of the sliced food product. As an example, adjustment can be achieved with an adjusting screw and/or pin 32 located circumferentially behind the pivot pins. FIG. 2 further shows optional gate insert strips 34 mounted with fasteners 35 to each shoe 26, which the food product crosses prior to encountering the knife 20 mounted to the succeeding shoe 26.

FIGS. 2 and 3 show the knives 20 and clamps 28B secured to their respective knife holders 28A with fasteners 36. Alignment of the knife 20 and clamp 28B of each assembly 28 is achieved with pins 38 that protrude from the support surface of the knife holder 26B. As better understood through the detail view of FIG. 4, the opposing surfaces of the knife holder 28A and clamp 28B result in the clamp 28B applying a force to the knife 20 adjacent its cutting edge. FIG. 5 shows an isolated exploded view of a shoe 26 and clamping assembly 28 of the cutting head 12 of FIGS. 2 and 3.

FIGS. 6 and 7 depict a quick-clamping assembly 40 that can be used in lieu of the fasteners 36 shown in FIGS. 2 and 3. The clamping assembly 40 comprises a knife holder 40A and clamp 40B, the latter of which may be similar if not identical to the clamp 28B of FIGS. 2 and 3. The knife holder 40A includes an insert 42 that supports the knife 20 near its cutting edge and serves to protect the edge of the knife holder 40A from stones or other debris that are often accompany food products that undergo slicing. The knife holder 40A and clamp 40B are loosely assembled together with a fastener 44 that is installed in the knife holder 40A, passes through the clamp 40B, and is threaded into a clamping bar 46. An eccentric clamping rod 48 is disposed within a recess 50 formed in a surface of the knife holder 40A, and has a flat 52 defined on its otherwise cylindrical peripheral surface. The clamping rod 48 is situated between and contacts the knife holder 40A and a proximal end of the clamp 40B opposite the knife 20. The rod 48 can be rotated between clamping and release positions, which serve to secure and release, respectively, the knife 20. The clamping position is depicted in FIG. 6 and results from the proximal end of the clamp 40B being engaged by the cylindrical surface of the rod 48, which forces the proximal end outward away from the knife holder 40A and, with the clamping bar 46 serving as a fulcrum, forces the oppositely-disposed end of the clamp 40B into engagement with the knife 20. The force applied to the clamp 40B by the rod 48 can be released by rotating the rod 48 so that its flat 52 faces the proximal end of the clamp 40B.

While the Model CC® has performed extremely well for its intended purpose, further improvements are continuously desired and sought for slicing machines of the type represented by the Model CC®.

BRIEF DESCRIPTION OF THE INVENTION

The present invention provides modular units with clamping assemblies for securing knives to slicing machines, and slicing machines having a cutting head equipped with one or more modular units mounted thereto for securing knives to the cutting head.

According to one nonlimiting aspect of the invention, such a slicing machine has an annular-shaped cutting head having first and second structural members spaced apart in an axial direction of the cutting head and circumferentially-spaced cutting units between the first and second structural members. Each cutting unit includes a knife holder adapted for supporting a knife, a clamp overlying the knife holder and arranged to apply a clamping force to a knife disposed between the knife holder and the clamp, and a cam rod adapted to apply a clamping force to the clamp. The clamp has first and second upstanding flanges, each having a hole therethrough and a slot that engages a pivot, and the clamp, slots, and pivots are arranged so that the clamp both pivots and translates relative to the pivots as the cam rod rotates between clamping and release positions.

Other aspects and advantages of this invention will be appreciated from the following detailed description.

DETAILED DESCRIPTION OF THE INVENTION

Figure 1:
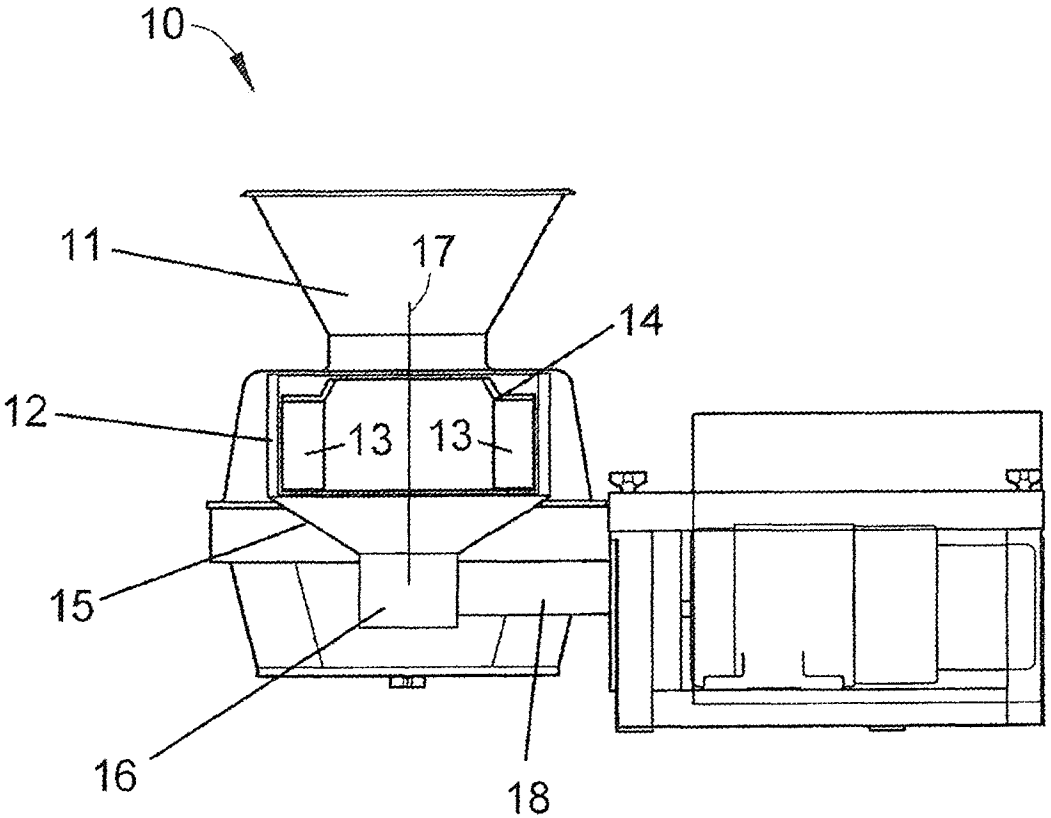
FIG. 1 PRIOR ART
FIG. 1 schematically represents a side view in partial cross-section of a slicing machine known in the art.
Figure 2:
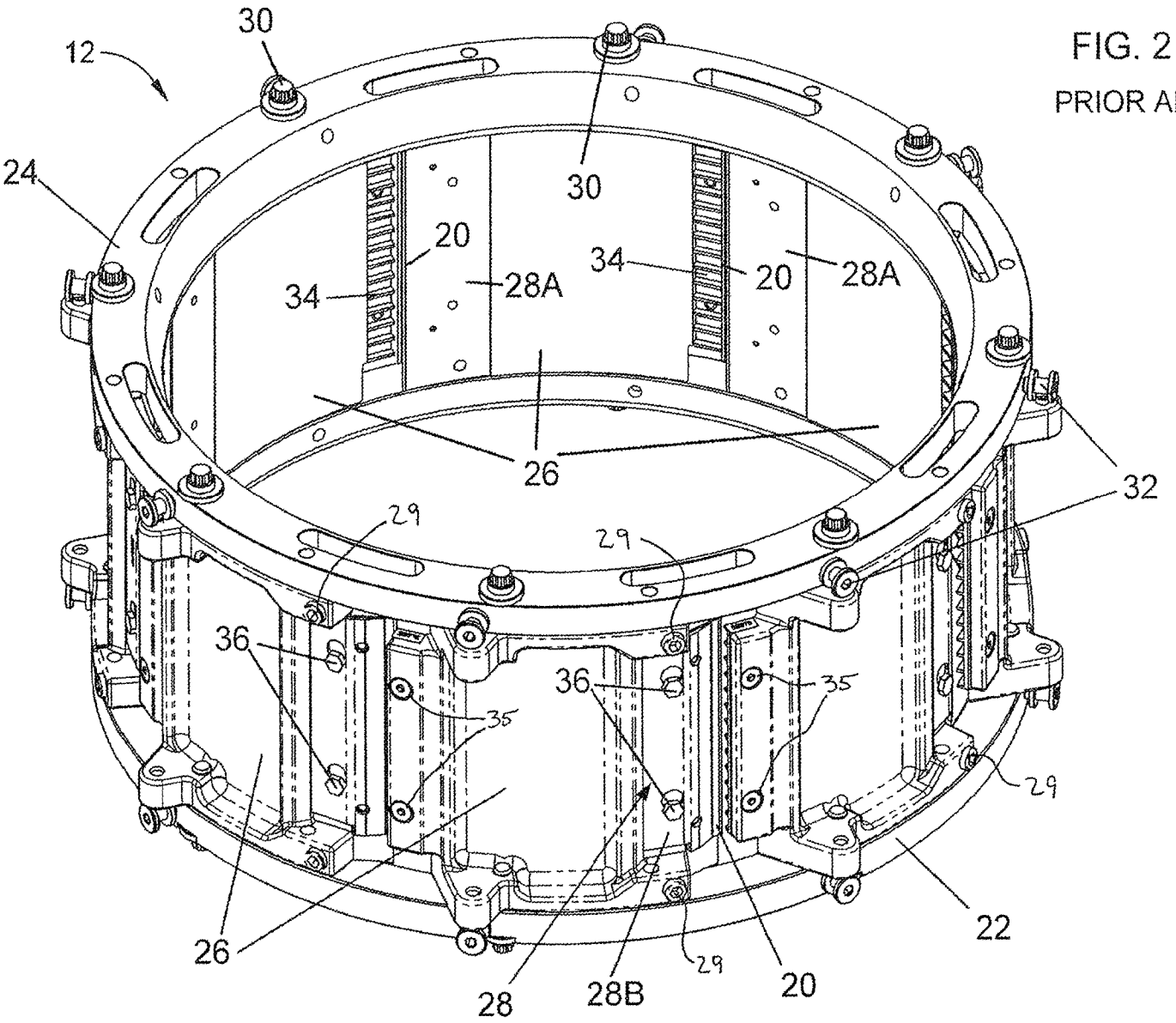
FIG. 2 PRIOR ART
FIG. 2 is a perspective view representing a cutting head of a type suitable for use with the slicing machine of FIG. 1.
Figure 3:
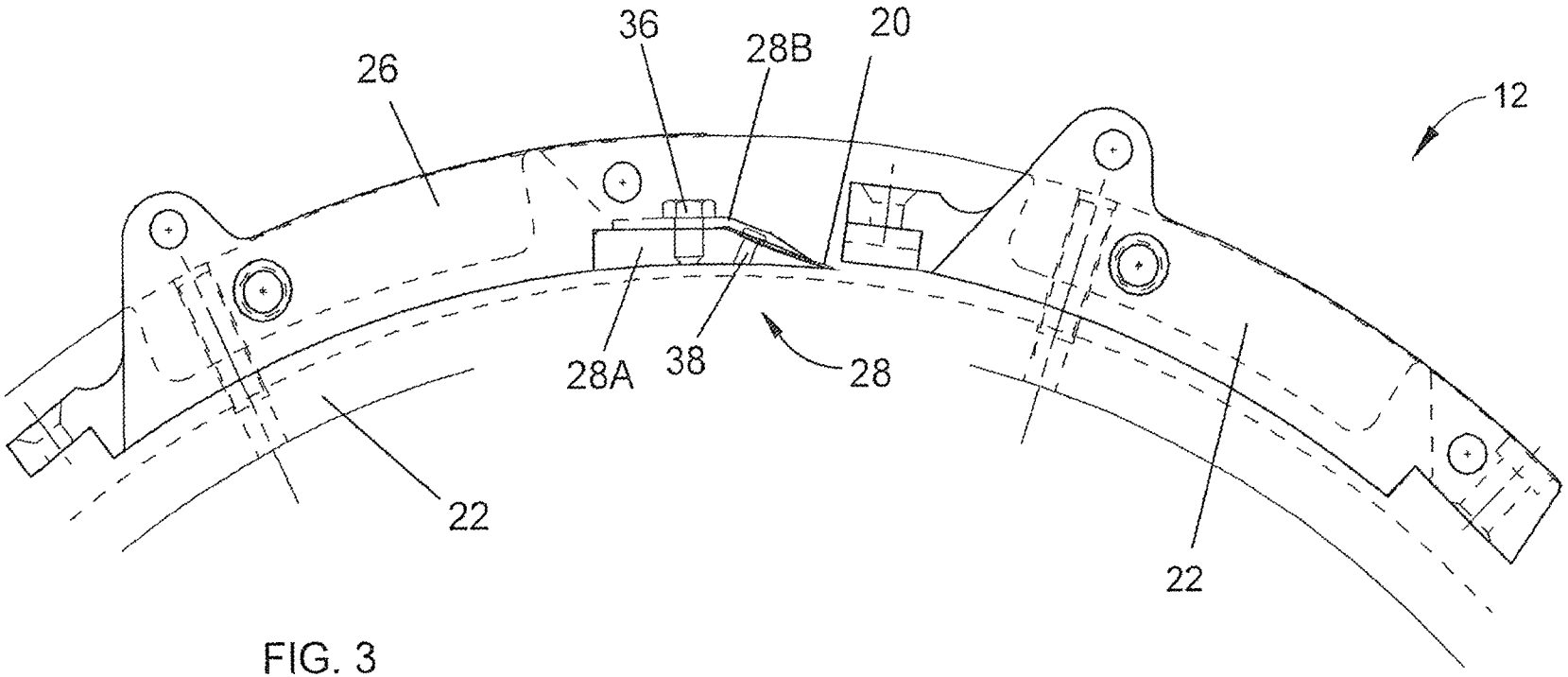
FIG. 3 PRIOR ART
FIG. 3 is a bottom view showing a fragment of the cutting head of FIG. 2.
Figure 4:
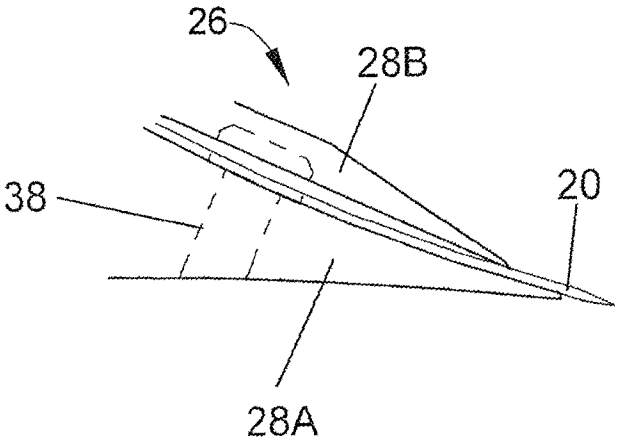
FIG. 4 PRIOR ART
FIG. 4 is a detailed view of a portion of a clamping assembly of the cutting head.
Figure 5:
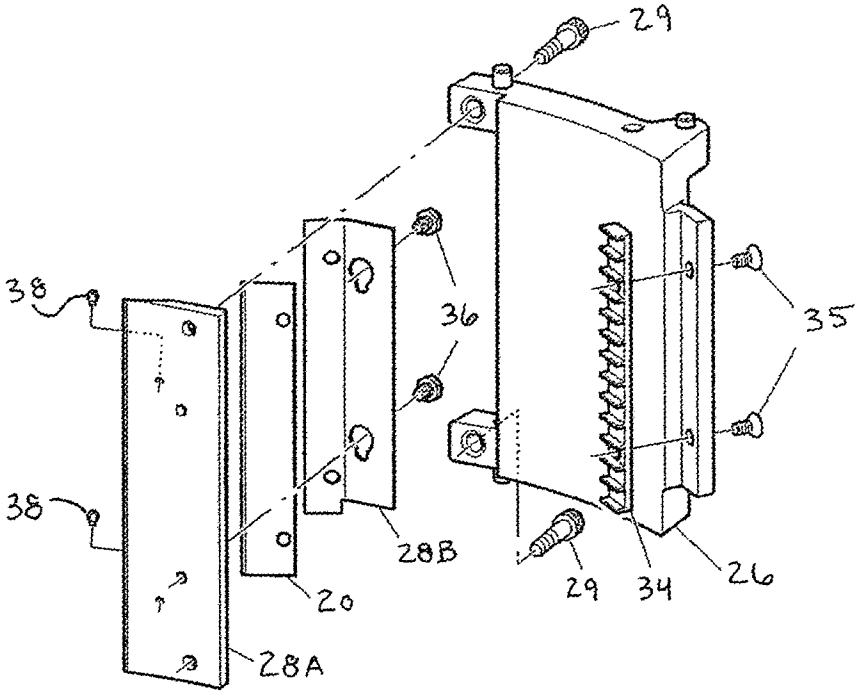
FIG. 5 PRIOR ART
FIG. 5 is an isolated exploded view of a shoe and a clamping assembly of the cutting head of FIGS. 2 and 3.
Figure 6:
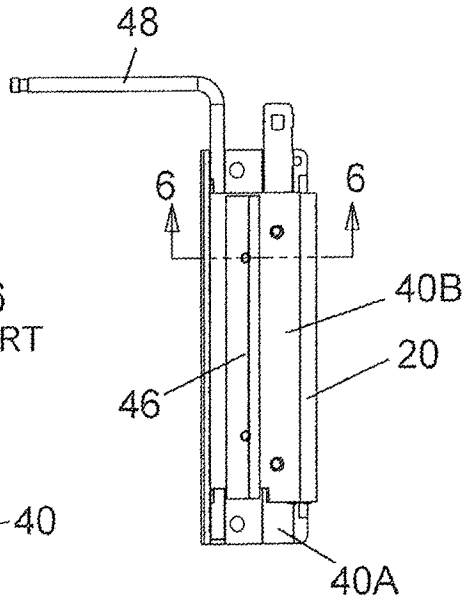
FIG. 6 PRIOR ART
FIGS. 6 and 7 are side and cross-sectional views, respectively, of an alternative clamping assembly capable of use with the cutting head of FIG. 2.
Figure 7:
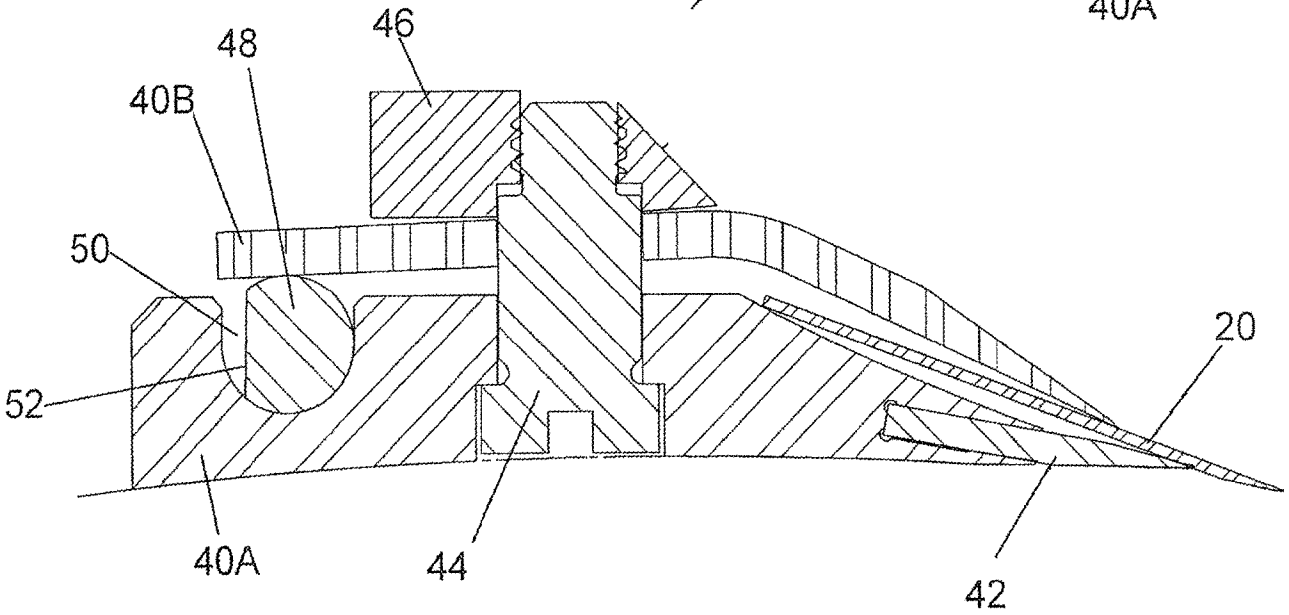
FIG. 7 PRIOR ART
Figure 8:
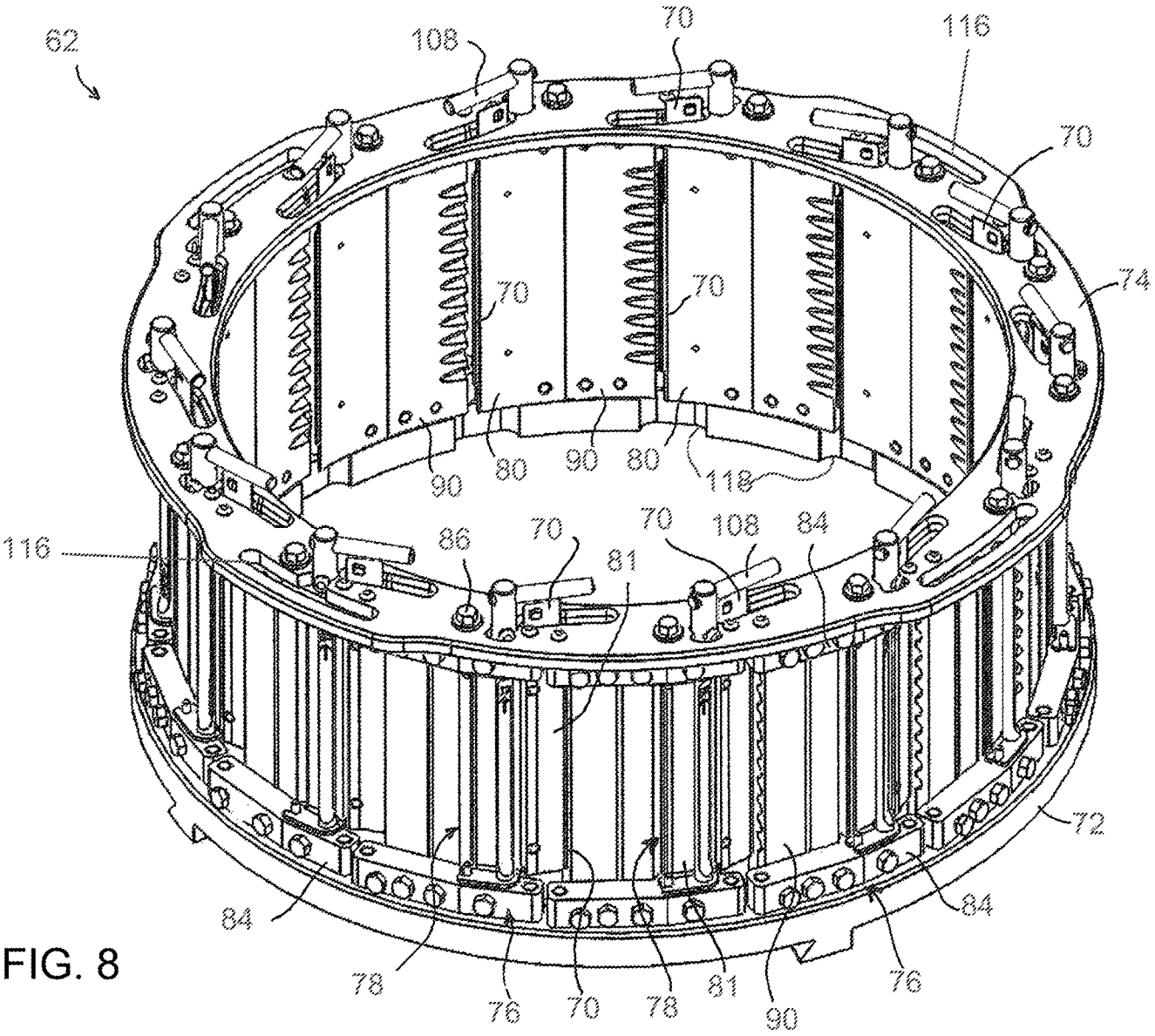
FIG. 8 is a perspective view representing a cutting head in accordance with a nonlimiting embodiment of the invention and configured for use with the slicing machine of FIG. 1.

FIG. 8 represents a nonlimiting embodiment of a cutting head 62 that is capable of use with a variety of cutting machines, including the slicing machine 10 depicted in FIG. 1, and in some instances may be a modification or retrofit for such a machine. FIGS. 9 through 13 contain various views of the cutting head 62 and modular units 76 thereof adapted to secure knives 70 to the cutting head 62. The cutting head 62 will be described hereinafter in reference to the slicing machine 10 of FIG. 1 equipped with an impeller 14 as described in reference to FIG. 1, and as such the following discussion will focus primarily on certain aspects of the invention, whereas other aspects not discussed in any detail may be, in terms of structure, function, materials, etc., essentially as was described in reference to FIGS. 1 through 7. However, it will be appreciated that the teachings of the invention are more generally applicable to other types of cutting machines.

To facilitate the description provided below of the embodiments represented in the drawings, relative terms, including but not limited to, "vertical," "horizontal," "lateral," "front," "rear," "side," "forward," "rearward," "upper," "lower," "above," "below," "right," "left," etc., may be used in reference to the orientation of the cutting head 62 as it would be mounted in the machine 10 of FIG. 1. On the basis of a coaxial arrangement of the cutting head 62 and the impeller 14 of the machine 10, relative terms including but not limited to "axial," "circumferential," "radial," etc., and related forms thereof may also be used below to describe the nonlimiting embodiments represented in the drawings. All such relative terms are intended to indicate the construction and relative orientations of components and features of the cutting head 62, and therefore are relative terms that are useful to describe the illustrated embodiments but should not be otherwise interpreted as limiting the scope of the invention.

In the isolated view of FIG. 8, the cutting head 62 can be seen to be generally annular-shaped with cutting knives 70 mounted at its perimeter. Each knife 70 projects radially inward in a direction generally opposite the direction of rotation of the impeller 14 within the cutting head 62, and defines a cutting edge at its radially innermost extremity. The cutting head 62 shown in FIG. 8 further comprises lower and upper support rings 72 and ring 74 to and between which the circumferentially-spaced modular units 76 are mounted. The upper support ring 74 is represented as comprising a handle 116 defined by an opening in the ring 74 to facilitate lifting of the cutting head 62, and the lower support ring 72 has an internal perimeter with circumferentially-spaced cut-outs 118 defined therein to reduce the weight of the cutting head 62.

Each modular unit 76 comprises a clamping assembly 78 that secures an individual knife 70 to the modular unit 76. As more readily evident in FIGS. 9 through 13, the clamping assembly 78 of each modular unit 76 includes a knife holder 80 mounted with fasteners 82 to and between a pair of mounting blocks 84, which in turn are configured to be secured to the support rings 72 and 74 with fasteners 86. Due to the positions of the rings 72 and 74 in the cutting head 62, the mounting blocks 84 are spaced apart in an axial direction of the cutting head 62. The fasteners 86 preferably rigidly secure the mounting blocks 84 to the rings 72 and 74. Each clamping assembly 78 further includes a clamp 81 mounted between the mounting blocks 84 so that the clamp 81 is positioned on the radially outward-facing side of the holder 80 to secure the knife 70 thereto. As will be discussed below, the clamp 81 is pivotably mounted to the mounting blocks 84. While various means could be used as pivots for the clamp 81, in the embodiment shown the fasteners 86 that secure the mounting blocks 84 to the rings 72 and 74 extend through the blocks 84 to also define pivot pins 86A for the clamp 81.

The mounting blocks 84 are equipped with pins 88 that engage holes (not shown) in the support rings 72 and 74. By appropriately locating the holes in the rings 72 and 74, the orientation of the mounting blocks 84, and consequently each knife 70, knife holder 80, and clamp 81 mounted thereto, can be used to alter the radial location of the cutting edges of the knives 70 with respect to the axis of the cutting head 62, thereby providing relatively coarse control of the thickness of the sliced food product. FIGS. 8 through 13 further show each modular unit 76 as comprising an adjustable gate 90 secured to the mounting blocks 84 with fasteners 92. A food product crosses the gate 90 prior to encountering the knife 70 mounted to the succeeding modular unit 76. To provide relatively fine control of the thickness of the sliced food product, the mounting blocks 84 are equipped with adjustment screws 94 that engage the gates 90 to alter the radial location of a trailing edge 96 (FIGS. 10 and 11) of the gate 90 relative to the cutting edge of the succeeding knife 70.

As more readily apparent from FIGS. 10 through 13, the knife 70 of each unit 76 is supported by a radially outer surface 80A of the knife holder 80, and the clamp 81 overlies the holder 80 so that the knife 70 is between the surface 80A of the holder 80 and a radially inward surface of the clamp 81 that faces the holder 80. Alignment of the knife 70, holder 80, and clamp 81 may be achieved with locating pins 98 that protrude from the knife holder 80 into complementary slots and/or holes in the knife 70 and clamp 81. As evident from FIGS. 10 through 13, by forcing the clamp 81 toward the holder 80, an extension 81A of the clamp 81 will apply a clamping force to the knife 70 adjacent its cutting edge.

According to a preferred aspect of the invention, an eccentric cam rod 100 is used as a quick-clamping feature to apply the clamping force to the clamp 81. The cam rod 100 is rotatably received in holes 102 in the mounting blocks 84 and passes through complementary holes 104 on upstanding flanges 81B of the clamp 81 located at opposite ends of the clamp 81 to secure the clamp 81 to the mounting blocks 84 in combination with the pivot pins 86A of the clamp 81 created by the fasteners 86, which are shown as engaged by a slot 106 formed in each upstanding flange 81B of the clamp 81. The holes 104 are located adjacent the extension 81A of the clamp 81 and the slots 106 are D-shaped and open at an end of each upstanding flange 81B opposite the extension 81A.

Figure 11:
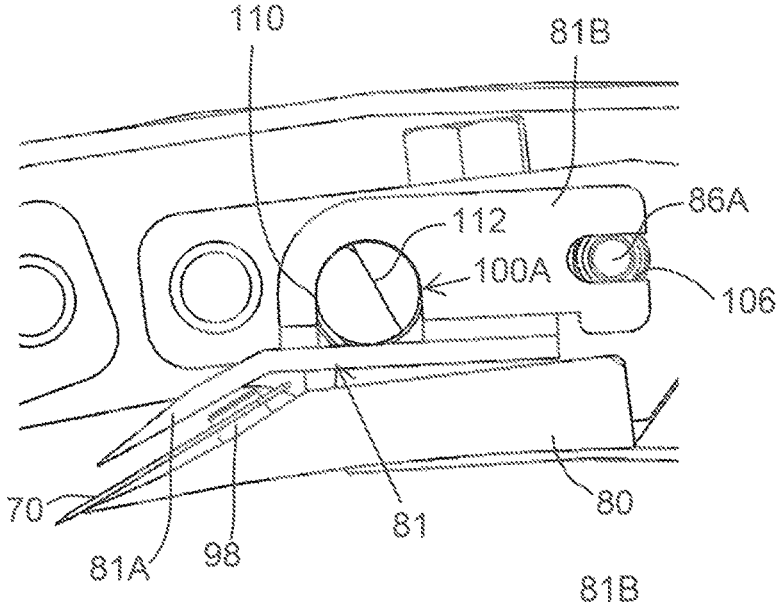
FIGS. 11 through 13 are cross-sectional views of a modular unit of the type represented in FIGS. 8 and 9, and represent the movement of a clamp from a release position (FIG. 11) at which a knife is released from the unit, to a clamping position (FIG. 13) at which the knife is secured to the unit.

The cam rod 100 comprises a camming portion 100A that engages and disengages the clamp 81 when the cam rod 100 is rotated between clamping and release positions, which serve to secure and release, respectively, the knife 70. The release position is depicted in FIG. 11 and results from the camming portion 100A being disengaged from the clamp 81, whereas counterclockwise rotation of the rod 100 (as viewed in FIGS. 11 and 13) causes its camming portion 100A to eccentrically move into engagement with the surface of the clamp 81, forcing the clamp 81 into engagement with the knife 70. The clamping force applied to the clamp 81 by the camming portion 100A can be released by rotating the cam rod 100 in the clockwise direction.

Figure 9:
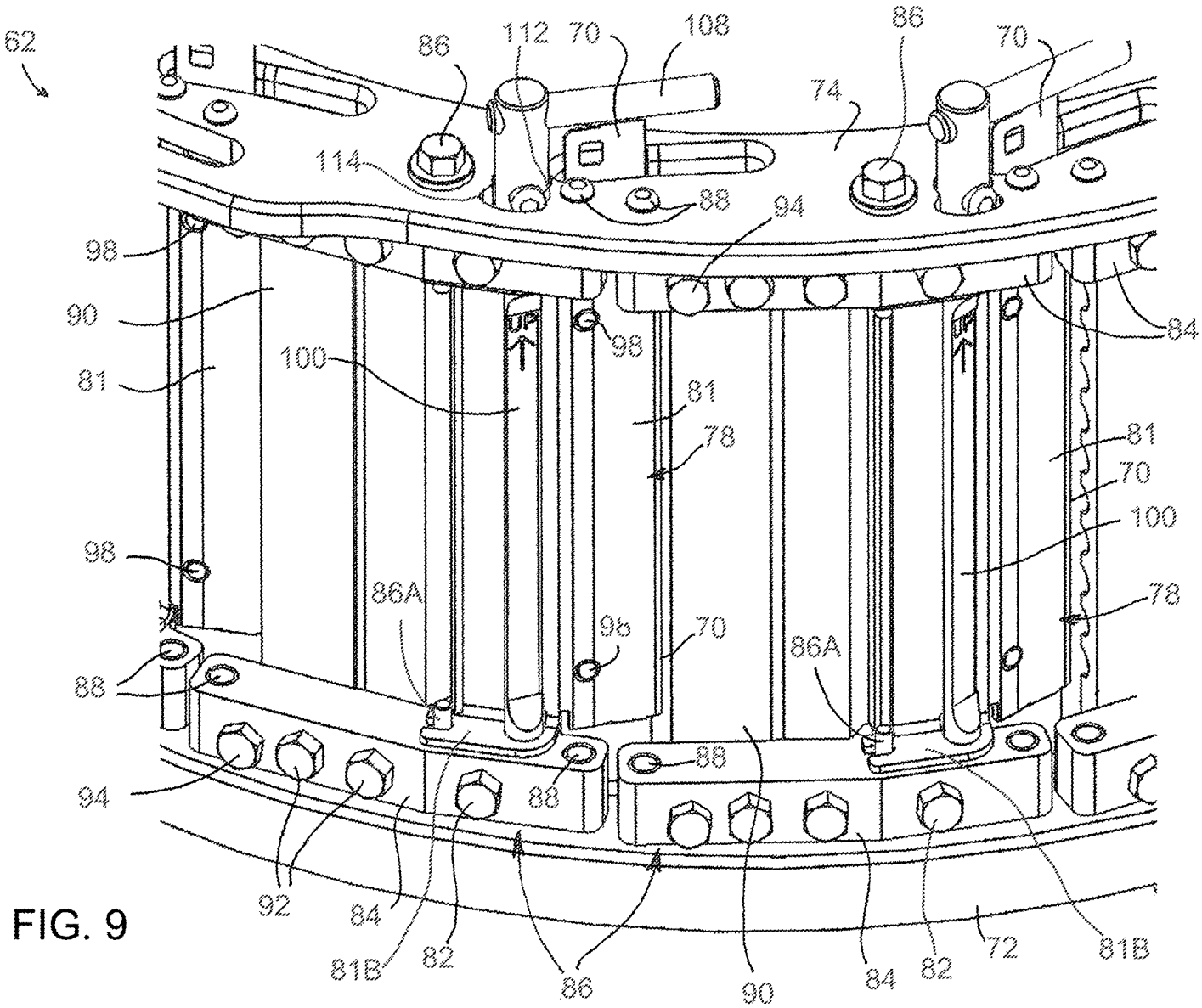
FIG. 9 is a perspective view showing in more detail a portion of the cutting head of FIG. 8.
Figure 10:
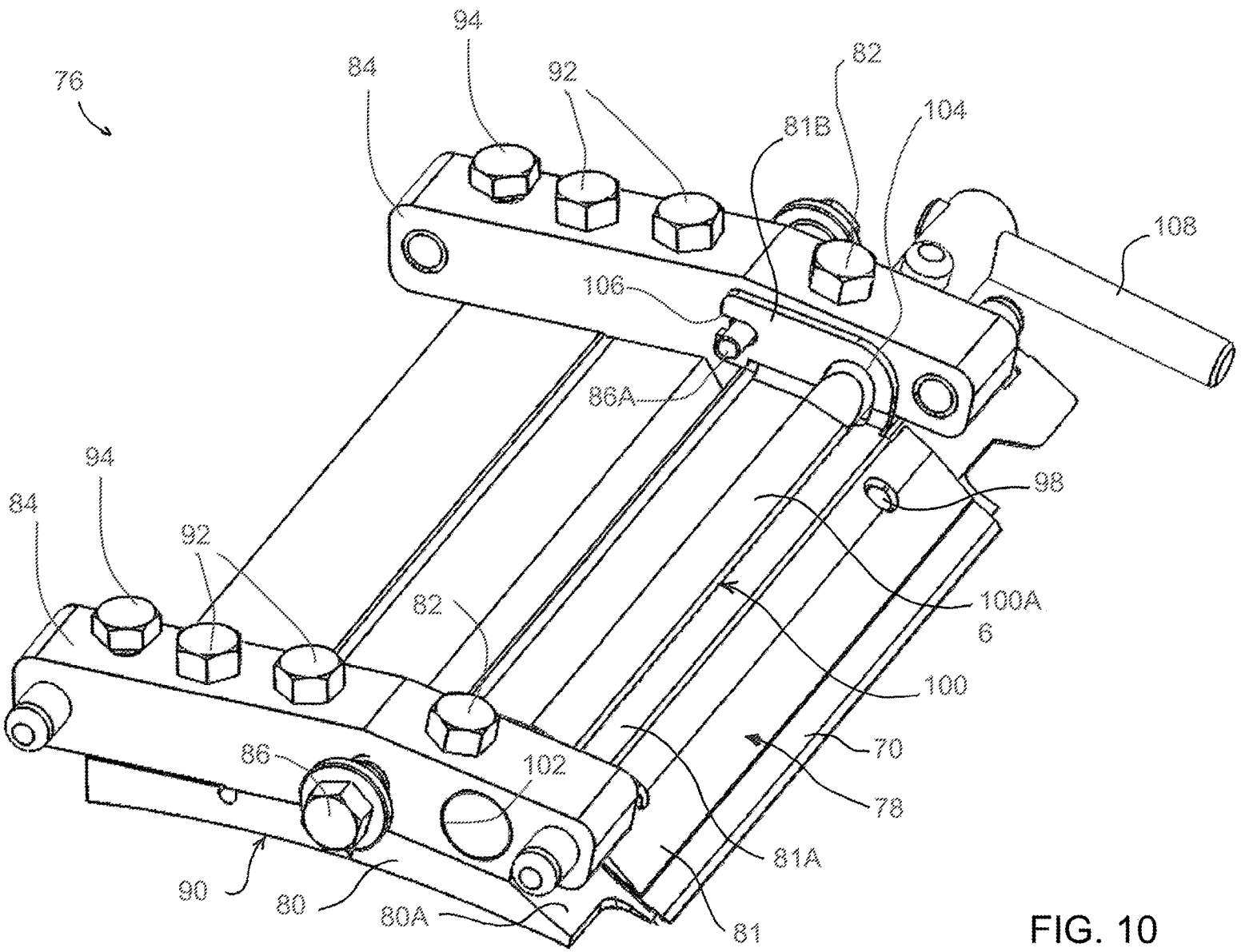
FIG. 10 is a perspective view showing in isolation a modular unit of the cutting head of FIG. 8.

As previously noted, the cam rod 100 is rotatably mounted to the mounting blocks 84 of the modular unit 76 as a result of having end portions thereof rotatably received in the holes 102 formed in the mounting blocks 84, enabling the rod 100 to rotate within the holes 102 between the aforementioned clamping and release positions. The end portions of the cam rod 100 are preferably coaxial, whereas the camming portion 100A between the end portions is eccentric to the end portions as well as the holes 102 in which the end portions are received, in other words, the axis of the camming portion 100A is parallel but not coaxial with the end portions of the cam rod 100. A handle 108 is provided at one end of the rod 100 to facilitate its rotation by hand. In the illustrated embodiment, the handle 108 is attached to the rod 100 so as to be disposed above the support ring 74 as seen in FIGS. 8 and 9. The clamping and release positions of the cam rod 100 are represented in FIGS. 8 and 9 as being established by stops 112 and 114, respectively, defined by the support ring 74. The end portions of the cam rod 100 disposed within the holes 104 in the upstanding flanges 81B of the clamp 81 have diameters roughly equal to the holes 104 so as not to translate within the holes 104 but instead remain substantially coaxial with the holes 104, such that the cam rod 100 serves as a pivot for the clamp 81. Because each end portion of the cam rod 100 is rotatably and eccentrically coupled with one of the blocks 84, the clamp 81 both pivots and translates relative to its pivot pins 86A as the cam rod 100 rotates between the clamping and release positions, with translation being enabled by the slots 106 of the clamp 81.

The operation of the modular unit 76 will now be discussed in reference to FIGS. 11 through 13, which represent the knife 70 as having a straight cutting edge for producing flat slices. Knives having straight cutting edges will be referred to herein as "flat" knives. Knives of other shapes can be used to produce sliced, strip-cut, shredded and granulated products.

Figure 12:
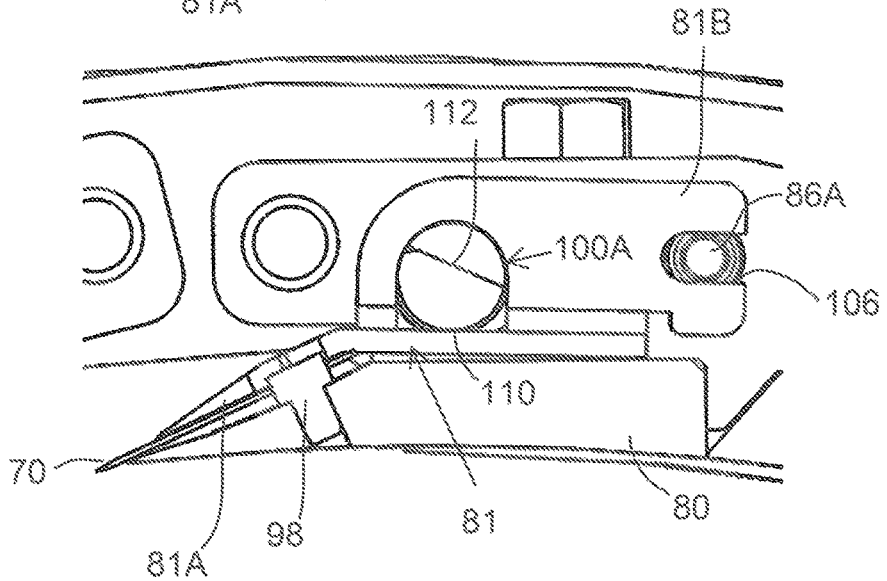
Figure 13:
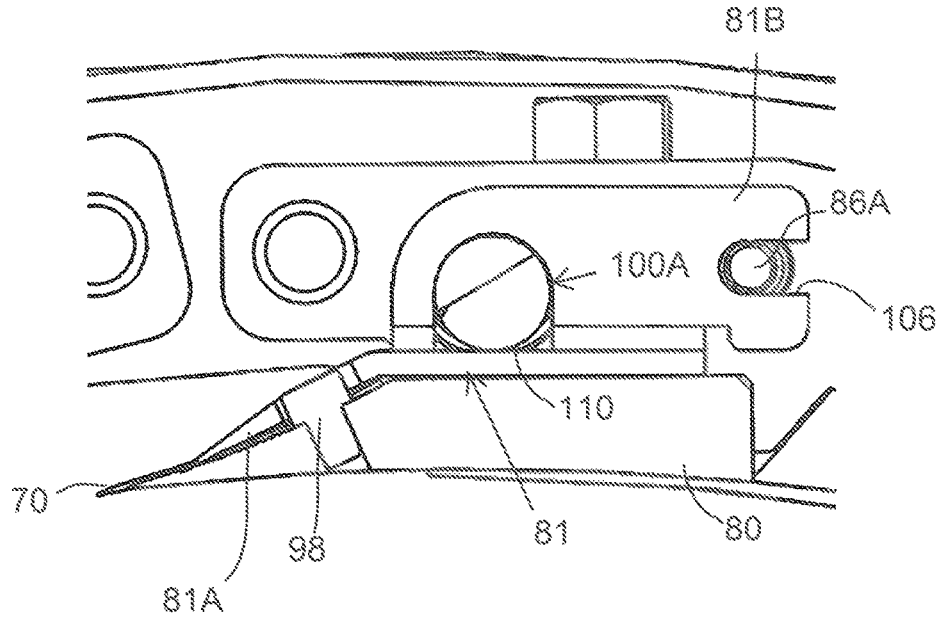

In FIGS. 11 through 13, the camming portion 100A is represented as having a circular cross-sectional shape that defines an arcuate camming surface 110 that contacts the outer surface of the clamp 81 and forces the clamp 81 toward the knife holder 80. In the clamping position (FIG. 13), the camming portion 100A is at its closest proximity to the knife holder 80 due to the eccentricity of the camming portion 100A, with the result that the camming portion 100A applies an increasingly greater force to the clamp 81 as the camming portion 100A is rotated in the clamping direction (counterclockwise in FIGS. 11 to 13). As a result, the knife 70 is clamped between the knife holder 80 and clamp 81.

The nonlimiting embodiment of the camming portion 100A shown in the drawings further comprises a planar surface 112, represented as lying on a chord of the otherwise circular cross-sectional outline defined by the camming portion 100A. As seen in FIG. 12, the planar surface 112 faces away from the clamp 81 when the camming portion 100A in both the release and clamping positions (FIGS. 11 and 13, respectively). The planar surface 112 is preferably present on the camming portion 100A to provide greater clearance for slices that travel over the knife 70 and the outer surface of the clamp 81 as the slices exit the cutting head 62.

The result of rotating the camming portion 100A of the rod 100 from its release position to its clamping position is depicted in FIGS. 11 to 13, the first of which shows the camming portion 100A as releasing the clamping force that the camming surface 110 had applied against the clamp 81. In the release position, which is represented in the drawings as the result of rotating the camming portion 100A about ninety degrees from its clamping position in FIG. 13, the camming portion 100A is at an intermediate distance from the knife holder 80 due to its eccentricity. From the transition from FIG. 11 through FIG. 12 to FIG. 13, the camming portion 100A can be seen as remaining coaxial with the hole 104 in the clamp 81, and the camming portion 100A causes the clamp 81 to be shifted toward the cutting edge of the knife 70 (referred to herein as "forward"), with the result that the extension 81A of the clamp 81 is disengaged from the knife 70. As seen in FIG. 11, as result of the forward movement or shift of the clamp 81, the pivot pin 86A is spaced apart from the bottom of the slot 106 (the left end of the slot 106 as viewed in FIG. 11), and instead is near the middle of the longitudinal length of the slot 106, in other words, roughly midway between the bottom of the slot 106 and the opening of the slot 106 (the right end of the slot 106 as viewed in FIG. 11). Though the camming portion 100A remains in contact with the clamp extension 81A in the release position, the clamping force applied by the camming portion 100A has been sufficiently released to enable the knife 70 to be removed from the modular unit 76.

During the clamping transition illustrated in FIG. 12 and finally FIG. 13, rotating the camming portion 100A to its clamping position causes the clamp 81 to shift away from the cutting edge of the knife 70 (referred to herein as "rearward"), with the result that the extension 81A of the clamp 81 engages the knife 70. As seen in FIG. 13, as a result of the rearward movement or shift of the clamp 81, the pivot pin 86A is at or at least nearer the bottom of the slot 106, and therefore at a remote location from the opening of the slot 106. During the transition between the release and clamping positions, the slots/holes in the knife 70 and clamp 81 engage and disengage their complementary locating pins 98 of the knife holder 80. Notably, the rearward motion of the clamp 81 enabled by the slot 106 during the clamping transition shown in FIGS. 11 through 13 helps to seat the knife 70 against the surface 80A of the knife holder 80 and its locating pins 98.

While the invention has been described in terms of specific or particular embodiments, it should be apparent that alternatives could be adopted by one skilled in the art. For example, the machine 10, cutting head 62, impeller 14, modular units 76, and their respective components could differ in appearance and construction from the embodiments described herein and shown in the drawings, functions of certain components could be performed by components of different construction but capable of a similar (though not necessarily equivalent) function, and various materials could be used in the fabrication of the machine 10, cutting head 62, impeller 14, modular units 76, and their respective components. As such, it should be understood that the above detailed description is intended to describe the particular embodiments represented in the drawings and certain but not necessarily all features and aspects thereof, and to identify certain but not necessarily all alternatives to the represented embodiments and described features and aspects. As a nonlimiting example, the invention encompasses additional or alternative embodiments in which one or more features or aspects of a particular embodiment could be eliminated or two or more features or aspects of different embodiments could be combined. Accordingly, it should be understood that the invention is not necessarily limited to any embodiment described herein or illustrated in the drawings. It should also be understood that the phraseology and terminology employed above are for the purpose of describing the illustrated embodiment, and do not necessarily serve as limitations to the scope of the invention. Therefore, the scope of the invention is to be limited only by the following claims.

The invention claimed is:

1. A slicing machine having an annular-shaped cutting head comprising:

first and second structural members spaced apart in an axial direction of the cutting head;

circumferentially-spaced cutting units between the first and second structural members, each of the cutting units comprising:

a knife holder adapted for supporting a knife;

a clamp overlying the knife holder and arranged to apply a clamping force to a knife disposed between the knife holder and the clamp, the clamp having first and second upstanding flanges each having a hole therethrough and a slot that engages a pivot; and a cam rod adapted to apply a clamping force to the clamp;

wherein the clamp, the slots, the cam rod, and the pivots are arranged so that the clamp both pivots and translates relative to the pivots as the cam rod rotates between clamping and release positions, and wherein the cam rod has first and second end portions each received in a corresponding one of the holes in the first and second upstanding flanges of the clamp, the first and second end portions each having a diameter equal to the corresponding one of the holes and does not translate within the corresponding one of the holes.

2. The slicing machine according to claim 1, wherein the slots in the first and second upstanding flanges are D-shaped and are open at an end of each the first and second upstanding flanges.

3. The slicing machine according to claim 1, wherein the hole in each of the first and second upstanding flanges is located adjacent an extension of the clamp and the slot in each the first and second upstanding flanges is located at an end of each the first and second upstanding flanges opposite the extension of the clamp.

4. The slicing machine according to claim 1, wherein each of the first and second structural members comprises mounting blocks that mount the cutting units to the first and second structural members and comprise the pivots.

5. The slicing machine according to claim 4, wherein each of the cam rods secures a corresponding one of the clamps to a pair of the mounting blocks.

6. The slicing machine according to claim 5, wherein at least portions of the cutting units are removable from the cutting head by disassembling the cutting units from the mounting blocks without removing the mounting blocks from the cutting head.

7. The slicing machine according to claim 1, wherein the cam rod is rotatably and eccentrically coupled to the cutting unit such that a camming portion thereof is closer to the knife holder in the clamping position and is farther from the knife holder in the release position.

8. The slicing machine according to claim 1, wherein the first and second structural members comprise support rings that are spaced apart in the axial direction of the cutting head.

9. The slicing machine according to claim 1, further comprising a first stop that prevents rotation of the cam rod beyond the clamping position and a second stop that prevents rotation of the cam rod beyond the release position.

10. The slicing machine according to claim 9, wherein the first and second stops are defined by one of the first and second structural members.

11. The slicing machine according to claim 1, wherein at least the first structural member comprises a handle defined by an opening in the first structural member.

12. The slicing machine according to claim 1, wherein the first structural member is disposed above the second structural member, and the second structural member is a support ring having an internal perimeter with circumferentially-spaced cut-outs defined therein.

13. The slicing machine according to claim 1, wherein the slicing machine further comprises an impeller coaxially mounted within the cutting head for rotation about an axis of the cutting head in a rotational direction relative to the cutting head, the impeller has paddles for delivering food products radially outward toward the cutting head, and the knife extends radially inward toward the impeller in a direction opposite the rotational direction of the impeller.

14. A slicing machine having an annular-shaped cutting head and an impeller coaxially mounted within the cutting head for rotation about an axis of the cutting head in a rotational direction relative to the cutting head, the cutting head comprising:

first and second structural members spaced apart in an axial direction of the cutting head, each of the first and second structural members comprising circumferentially-spaced mounting blocks that define pivots;

circumferentially-spaced cutting units between the first and second structural members and mounted thereto by the mounting blocks, each of the cutting units comprising:

a knife holder;

a knife supported by the knife holder;

a clamp overlying the knife holder so that the knife is between the knife holder and the clamp, the clamp comprising first and second upstanding flanges and an extension therebetween adapted and arranged relative to the knife to apply a clamping force to the knife, the first and second upstanding flanges each comprising a hole therethrough and a slot that engages one of the pivots of the mounting blocks, the hole in each of the first and second upstanding flanges being located adjacent the extension of the clamp and the slot in each the first and second upstanding flanges being open at an end of each the first and second upstanding flanges opposite the extension of the clamp, the clamp, the slots, and the pivots being arranged so that the clamp both pivots and translates relative to the pivots associated therewith;

a cam rod adapted to apply the clamping force to the clamp, the cam rod having first and second end portions and a camming portion therebetween, the camming portion being arranged for contacting the clamp, each of the first and second end portions of the cam rod being disposed within a corresponding one of the holes in the first and second upstanding flanges of the clamp and having a diameter equal to the corresponding one of the holes so as not to translate within the corresponding one of the holes, each of the first and second end portions of the cam rod being rotatably and eccentrically coupled with a corresponding one of the first and second structural members, the cam rod being rotatable to have a clamping position and a release position, the camming portion applying the clamping force that clamps the clamp against the knife holder when the cam rod is in the clamping position, the camming portion releasing the clamping force against the clamp when the cam rod is in the release position, the clamp both pivoting and translating relative to the pivot associated therewith as the cam rod rotates between the clamping and release positions.

15. The slicing machine according to claim 14, wherein each of the cam rods secures a corresponding one of the clamps to a pair of the mounting blocks.

16. The slicing machine according to claim 14, wherein at least portions of the cutting units are removable from the cutting head by disassembling the cutting units from the mounting blocks without removing the mounting blocks from the cutting head.

17. The slicing machine according to claim 14, wherein the first and second structural members comprise support rings that are spaced apart in the axial direction of the cutting head.

18. The slicing machine according to claim 14, wherein at least the first structural member comprises a handle defined by an opening in the first structural member.

19. The slicing machine according to claim 14, wherein the first structural member is disposed above the second structural member, and the second structural member is a support ring having an internal perimeter with circumferentially-spaced cut-outs defined therein.

* * * * *